US010086852B2

(12) United States Patent
Iler

(10) Patent No.: US 10,086,852 B2
(45) Date of Patent: Oct. 2, 2018

(54) END-OF CAR ENERGY MANAGEMENT SYSTEM FOR RAILCARS

(71) Applicant: CANADIAN NATIONAL RAILWAY COMPANY, Montreal (CA)

(72) Inventor: Darrell Iler, Crown Point, IN (US)

(73) Assignee: CANADIAN NATIONAL RAILWAY COMPANY, Montreal, Quebec (CA)

( * ) Notice: Subject to any disclaimer, the term of this patent is extended or adjusted under 35 U.S.C. 154(b) by 539 days.

(21) Appl. No.: 14/643,244

(22) Filed: Mar. 10, 2015

(65) Prior Publication Data

US 2015/0251671 A1 Sep. 10, 2015

Related U.S. Application Data

(60) Provisional application No. 61/950,763, filed on Mar. 10, 2014.

(51) Int. Cl.

| | |
|---|---|
| ***B61G 9/04*** | (2006.01) |
| ***B61G 9/10*** | (2006.01) |
| ***B61G 9/18*** | (2006.01) |
| ***B61G 9/12*** | (2006.01) |

(52) U.S. Cl.

CPC ..... *B61G 9/04* (2013.01); *B61G 9/10* (2013.01); *B61G 9/12* (2013.01); *B61G 9/18* (2013.01)

(58) Field of Classification Search

CPC ... B61G 9/04; B61G 9/10; B61G 9/12; B61G 9/18

See application file for complete search history.

(56) References Cited

U.S. PATENT DOCUMENTS

| | | | | | |
|---|---|---|---|---|---|
| 2,613,819 | A * | 10/1952 | Fillion | B61G 9/12 | 213/8 |
| 3,117,675 | A * | 1/1964 | Price | B61G 9/10 | 213/223 |
| 3,712,479 | A * | 1/1973 | Atkinson | B61G 9/06 | 213/45 |
| 3,788,493 | A * | 1/1974 | Hawthorne | B61G 9/04 | 213/20 |
| 3,800,961 | A * | 4/1974 | Hawthorne | B61G 9/04 | 213/43 |
| 3,840,126 | A * | 10/1974 | Domer | F02N 99/008 | 213/45 |
| 4,635,804 | A * | 1/1987 | Hanula | B61G 3/04 | 213/62 A |
| 6,681,943 | B2 * | 1/2004 | Barker | B61G 9/06 | 213/46 R |
| 8,870,002 | B2 | 10/2014 | Wilt et al. | | |
| 2002/0070189 | A1 * | 6/2002 | Barker | B61G 9/06 | 213/62 R |
| 2006/0124572 | A1 * | 6/2006 | Sommerfeld | B61G 9/22 | 213/75 R |

(Continued)

OTHER PUBLICATIONS

"End-of-Car Systems Update" by John Deppen, presented to the 2013 Damage Prevention and Freight Claim Annual Conference Jun. 17-19, 2013, 26 pages.

*Primary Examiner* — Zachary L Kuhfuss

(57) ABSTRACT

An end-of-car system for railcars is provided comprising an asymmetric draft gear mechanism offering shock absorption to a railcar when the latter is subjected to buff or draft forces. The end-of-car system may be retrofitted to railcars having a different type of shock absorption system.

10 Claims, 15 Drawing Sheets

(56) References Cited

U.S. PATENT DOCUMENTS

| | | | | |
|---|---|---|---|---|
| 2008/0011700 | A1* | 1/2008 | Brough | B61G 9/24 213/75 R |
| 2012/0199545 | A1* | 8/2012 | Peckham | B61G 11/16 213/65 |
| 2013/0168346 | A1 | 7/2013 | Wilt et al. | |
| 2013/0270210 | A1* | 10/2013 | Kukulski | B61G 9/10 213/62 R |
| 2017/0158211 | A1* | 6/2017 | Bonney | B61G 11/16 |

* cited by examiner

END-OF CAR ENERGY MANAGEMENT SYSTEM FOR RAILCARS

FIELD OF THE INVENTION

The present invention relates to end-of-car systems used in railcars to manage shocks and impacts experienced by the railcars when they are coupled to each other.

BACKGROUND OF THE INVENTION

Railcars are often subjected to low speed collisions experienced during operation of a train which can involve pulling, pushing, stopping or coupling railcars for example. Because of the significant mass that railcars possess, such collisions can result in damage not only to the railcars but also to the cargo they carry. For this reason, railcars are fitted with an end-of-car system to provide shock absorption and diminish the impact that low speed collisions might have on a railcar and/or its contents.

Two types of end-of-car energy management systems are currently being used in the industry: buffers (also called end-of-car cushion systems) and draft gears. Both buffers and draft gears provide shock absorption, however buffers use a fluid as a damping medium while draft gears are mechanical devices. Typically, a draft gear uses a spring-loaded mechanism where damping is achieved via friction. Examples of draft gears can be found in U.S. Pat. No. 8,870,002 and U.S. Pat. No. 8,939,300. The stroke length of buffers is generally significantly bigger than the stroke length of a draft gear and thus they typically provide better impact protection in buff (compression). However, a disadvantage of buffers is that they need regular maintenance and inspection in order to ensure that no leaks are present. Failure to do so may result in buffer malfunction and thus a possible accident. Moreover, regulations regarding the maintenance of buffers are stringent and if not followed can result in significant penalties to the railway operator.

Moreover, buffers are designed such that they cannot provide protection against draft forces. They only operate in a buff direction. As a result, the knuckles that connect railcars to each other experience severe stresses when a car is being pulled, such as when the train accelerates. Knuckle breakage is not uncommon on railcars using buffers for energy management.

End of car energy management systems that provide draft protection exist. Those systems are designed on the principle that the longer the draft stroke the better the performance. However, long draft strokes have an unintended disadvantage, which is the build up of slack between the railcars that needs to be factored in the design and the installation of the pneumatic hose connections that run from one railcar to the other. To accommodate the slack, a sufficient excess of pneumatic hose length must be provided to avoid over stretching the hose when the energy management system is fully extended. The excess hose length may become so long that the hoses may drag on the ground when an energy management system is in a neutral operating position. To avoid that issue, a support system for the hoses is required, which is costly to procure, install and maintain.

Draft gears generally have a short stroke length and therefore do not provide comparable impact protection to buffers, however draft gears are not subject to leaks since they don't use hydraulic components and thus are inherently more reliable.

SUMMARY OF THE INVENTION

According to an aspect of the invention, there is provided an end of railcar energy management system. The end of railcar energy management system comprises a draft gear unit. The end of railcar energy management system is responsive to a buff force to compress over a buff stroke. The end of railcar energy management system is also responsive to a draft force to expand over a draft stroke. The buff stroke is greater than the draft stroke.

This aspect and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of the embodiments of the present invention is provided herein below, by way of example only, with reference to the accompanying drawings, in which.

DETAILED DESCRIPTION OF THE EMBODIMENTS

Figure 1:
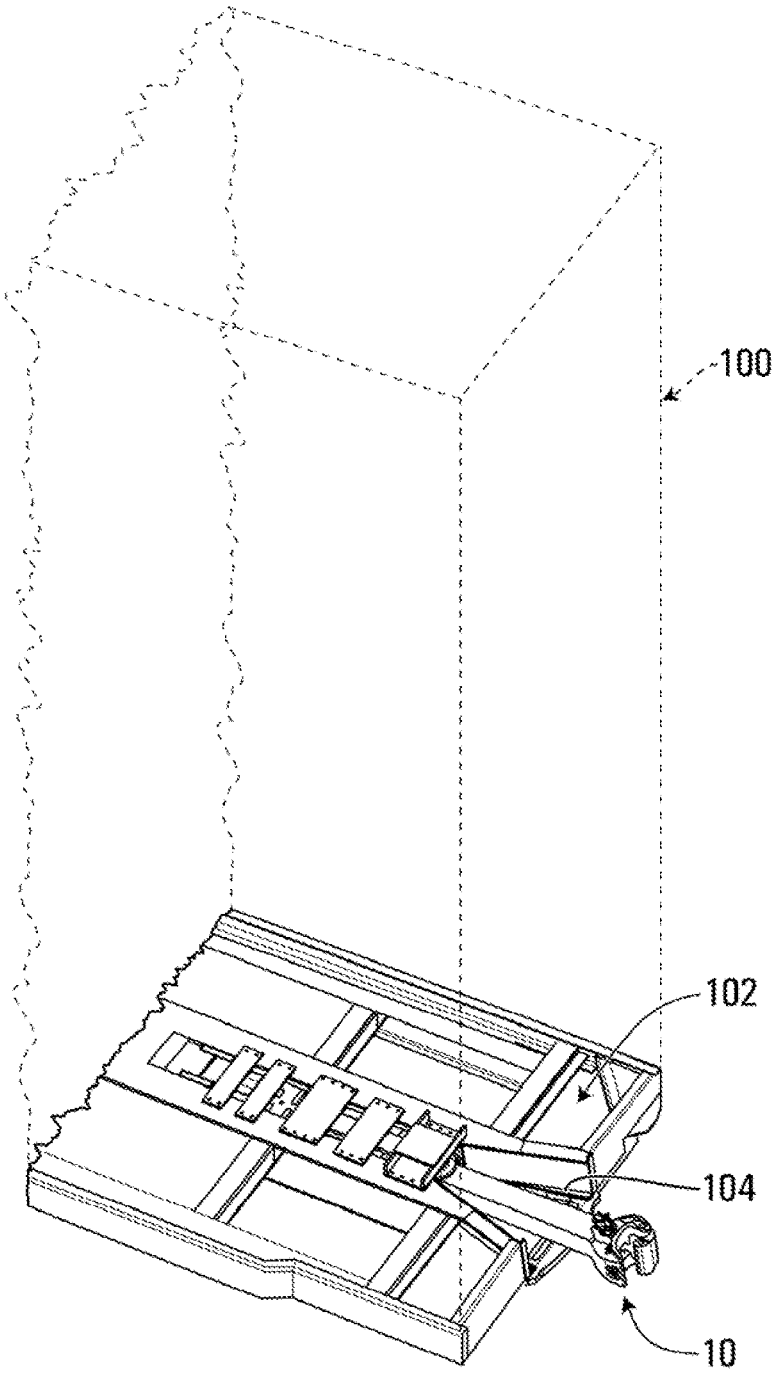
FIG. 1 is a perspective view of a railcar fitted with an end-of-car energy management system constructed in accordance with the invention.

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents. Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 13:
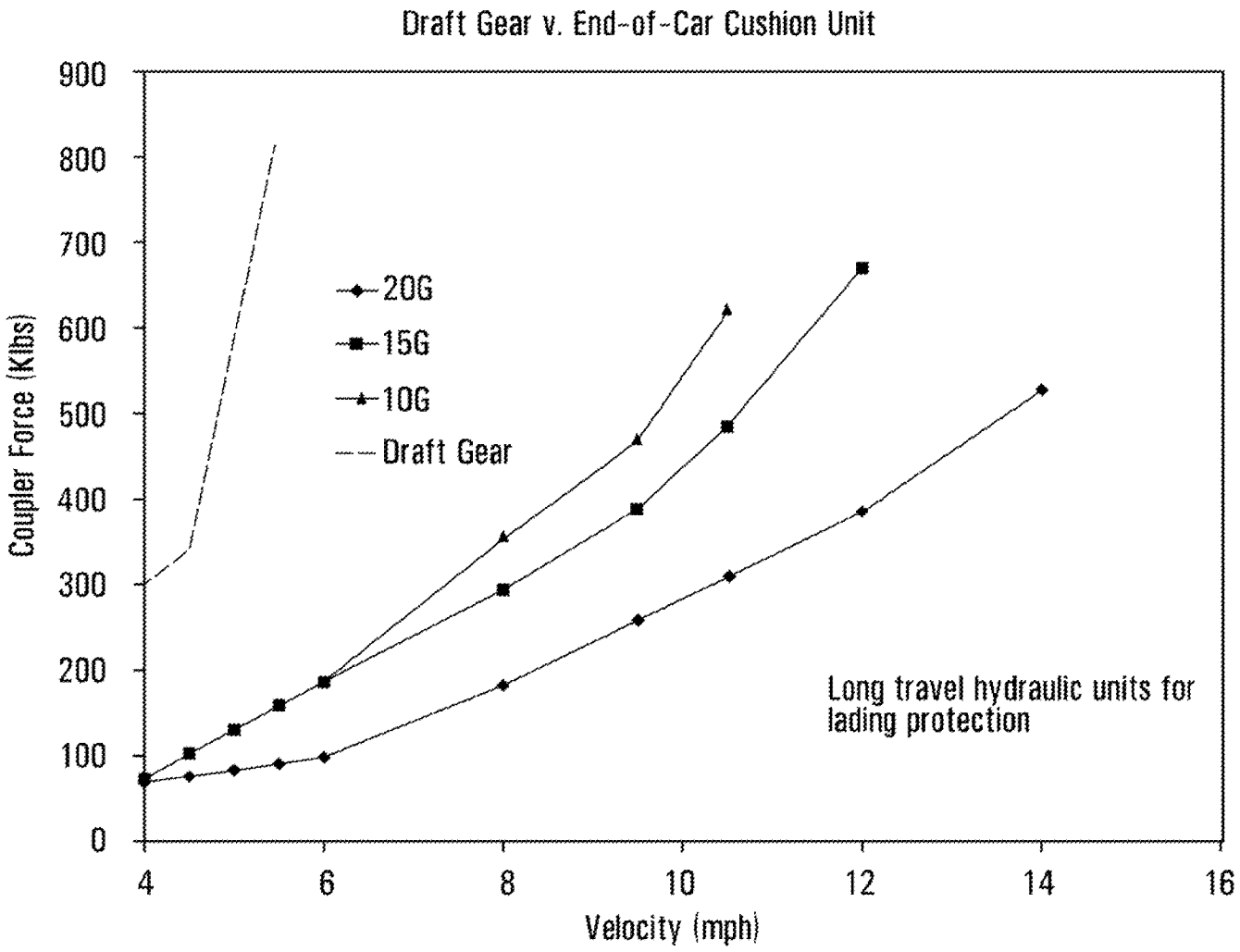
FIG. 13 is a performance plot comparing the performance of buffer units and typical draft gear mechanisms.

Illustrated in FIG. 13 is a performance plot displaying results of impacts experienced by different end-of-car systems as a result of buff (compression) forces. Three trendlines show the performance of buffer units (also called end-of-car cushion units), which use hydraulic cylinders as dampening means, and the left-most trendline is indicative of the performance of a typical draft gear, which uses a friction-based mechanism to provide shock absorption. As can be gathered from the performance plot, the buffer units are capable of absorbing greater impacts in compression than typical draft gears. The difference in performance is mainly due to a superior stroke length offered by hydraulic cylinders as compared to the friction-based mechanisms of draft gears. In the specific example shown, the compression stroke of the hydraulic cylinder is of about 7 inches while the compression stroke of the draft gear is of 3.5 inches. However, hydraulic components such as those found in buffer units require regular inspection and maintenance since a leak of the fluid contained within the component can significantly degrade its performance. In contrast, draft gears do not require such regular maintenance and inspection since a friction-based mechanical device is inherently more reliable.

Figure 2:
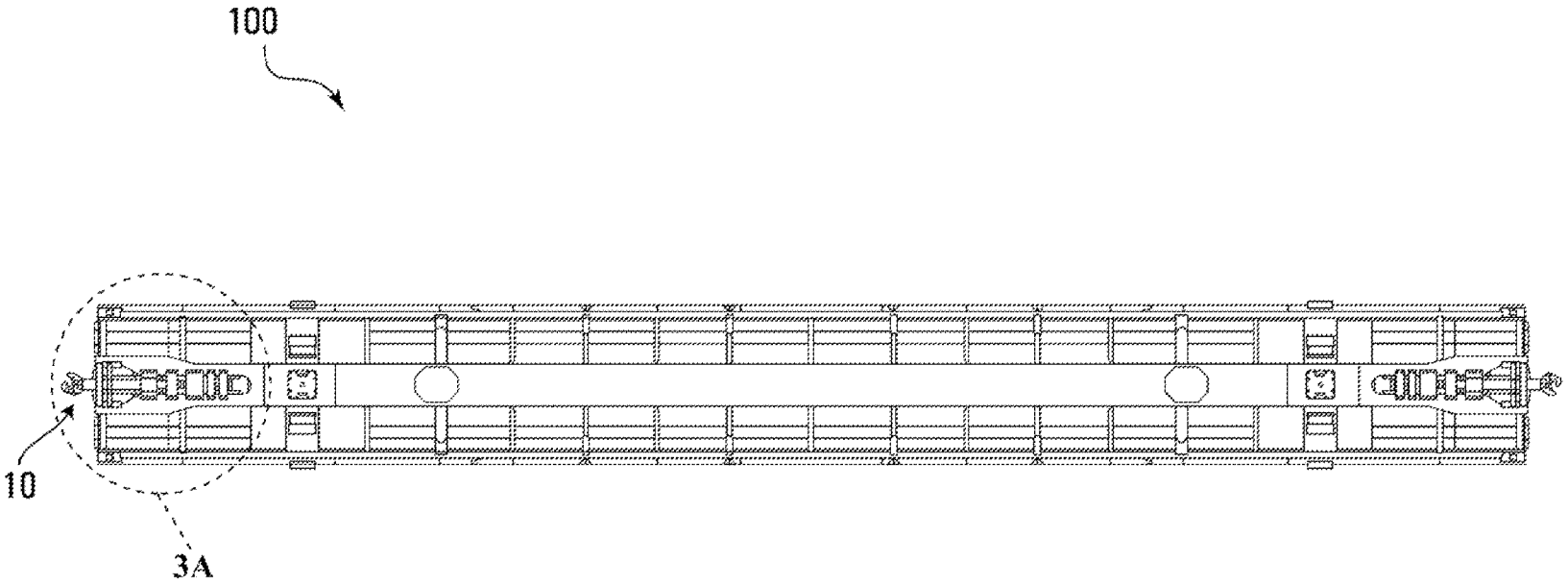
FIG. 2 is a top view, partly cut-away of the railcar fitted with the end-of-car energy management system.
Figure 3A:
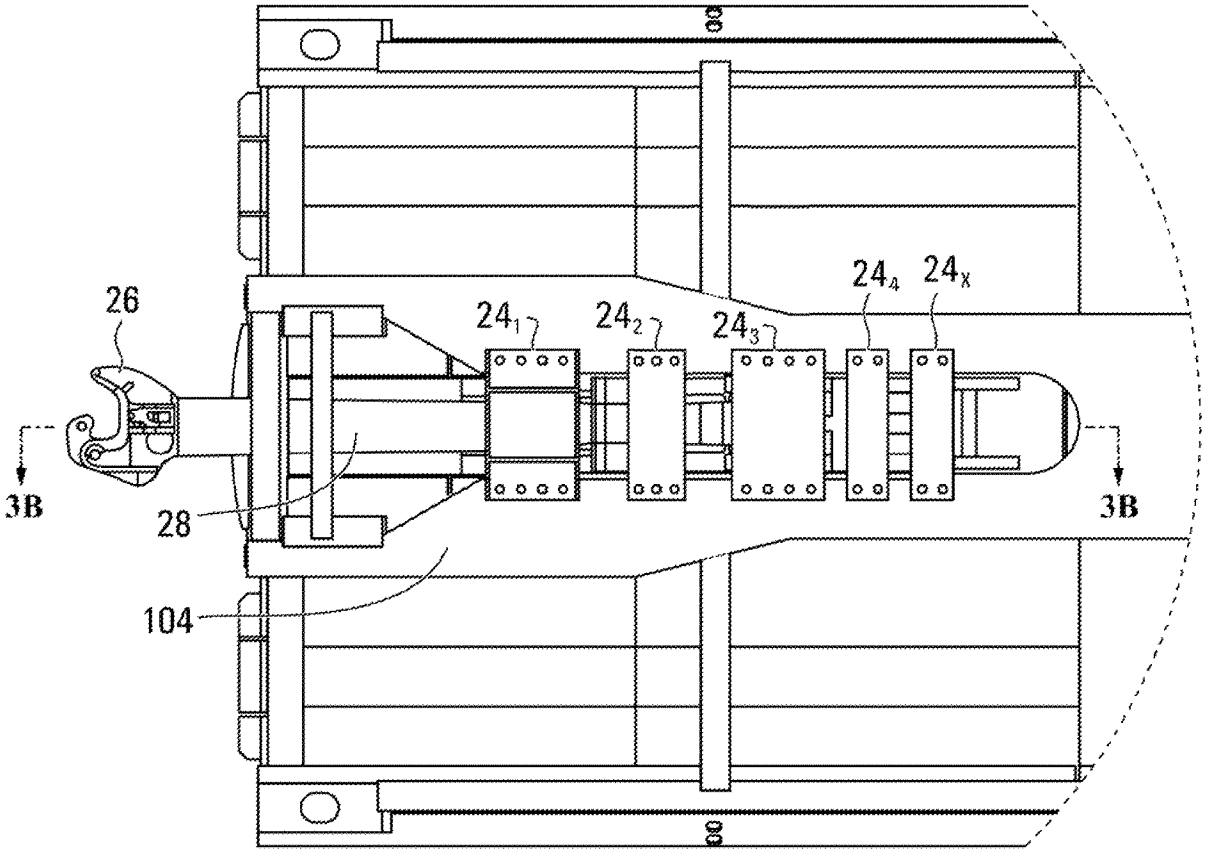
FIG. 3A is a more detailed plan view of the end-of-car energy management system of FIG. 2A.
Figure 3B:
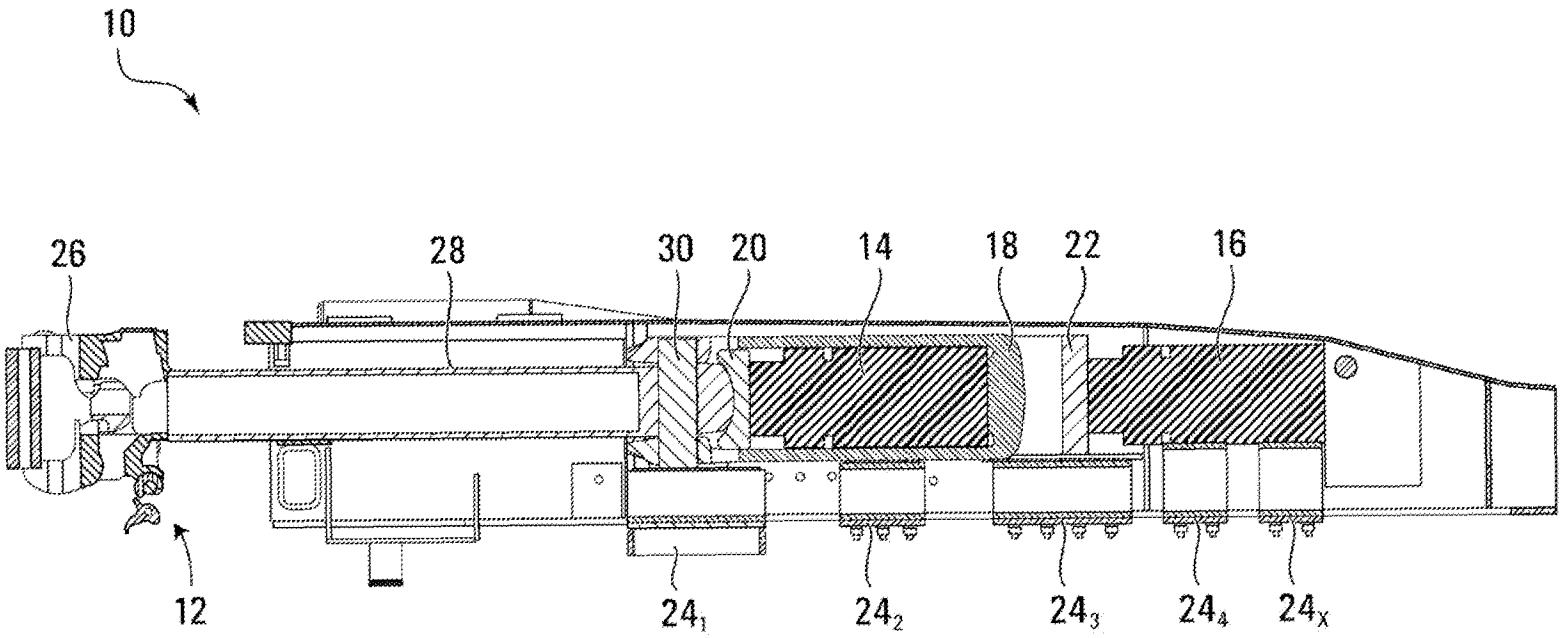
FIG. 3B is a vertical longitudinal cross-sectional view of the end-of-car energy management system of FIG. 3A.

Shown in FIG. 1 is an example of a railcar 100 having an end-of-car system 10 for providing shock absorption to the railcar 100 in accordance with an embodiment of the invention. As will be discussed further, the end-of-car system 10 is an asymmetric draft gear based mechanism, which is installed in the frame 102 of the railcar 100 and more specifically within a pocket of the frame 102. As shown in FIG. 2, the railcar 100 may be fitted with a similar end-of-car system at an opposite end.

As shown in FIGS. 3A to 5, the end-of-car system 10 comprises a coupler assembly 12 for enabling a coupling connection between railcars; first and second draft gear units 14, 16 for providing shock absorption capability to the railcar 100; a pulling bar 18 for actuating the first drive gear 14 to provide draft shock protection; a front follower 20 for causing compression of the draft gears units 14, 16; a follower block 22 for connecting to and actuating the second draft gear unit 16; and support members $\mathbf{24}_1$-$\mathbf{24}_x$ for providing support to different components of the end-of-car system 10.

The coupler assembly 12, comprising a coupling 26 and an elongated member 28, is operable to connect two railcars in a non-permanent manner by establishing a connection between the coupling 26 and a matching coupling on another railcar such that one railcar follows the other when coupled. The elongated member 28 of the coupler assembly 12 has a hollow structure and is mounted to the front follower 20. In addition, the elongated member 28 is connected to the pulling bar 18 via a connector pin 30, which extends through an aperture in the pulling bar 18.

Figure 6A:
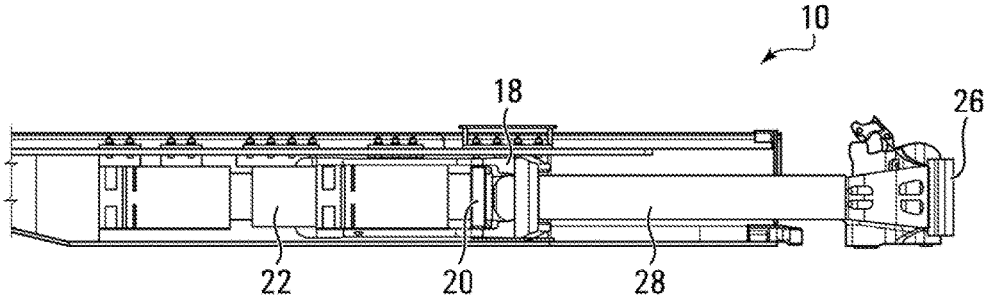
FIG. 6A is a longitudinal cross-sectional view of the end-of-car energy management system in a neutral operational position.
Figure 7A:
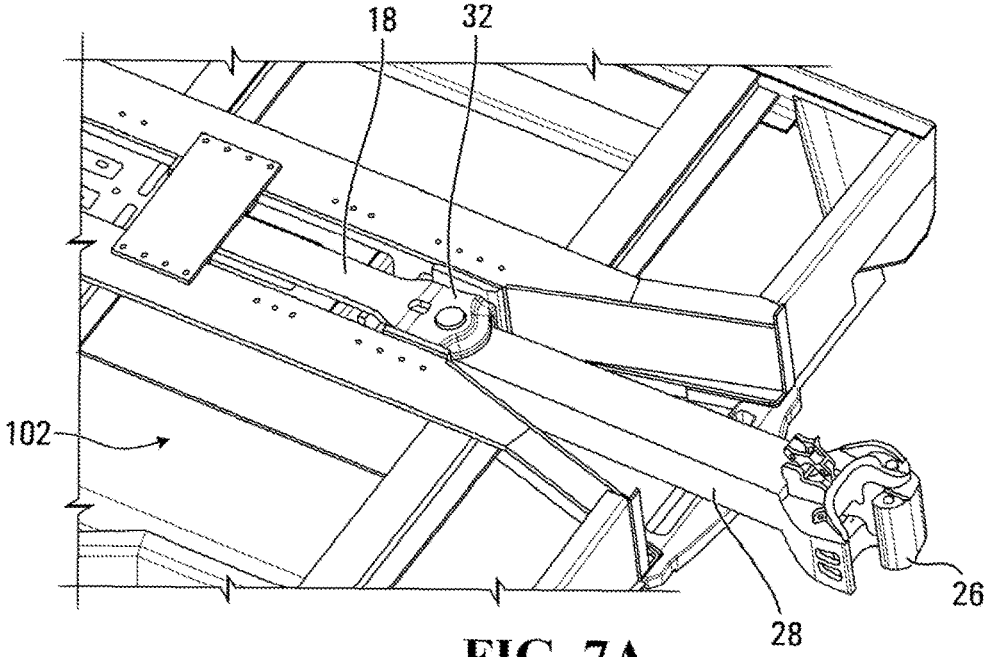
FIG. 7A is a perspective view of a frontmost part of the end-of-car energy management system in the neutral operational position.

The first draft gear unit 14 comprises a housing 34 and a friction clutch 36, the friction clutch 36 being operable to retract within the housing 34 up to a maximum length known as the stroke length $S_1$. The retraction of the friction clutch 36 is resisted by a spring mechanism (not shown) contained within the housing 34, the natural tendency of the spring mechanism being to push the friction clutch 36 outwards such that it protrudes from the housing 34. The manner in which a draft gear's spring mechanism operates is known in the art and thus will not be further described here. Suffice it to say that a neutral position of the first draft gear unit 14 is assumed when no force (i.e., compression or tension force) is applied to the end-of-car system 10. As shown in FIGS. 6A and 7A, in the neutral operational position, the friction clutch 36 protrudes from the housing 34.

In the specific example of implementation the stroke length $S_1$ is about three and a half inches. The overall length of the drive gear unit 14 can be of 25 and ⅝ inches. These dimensions are generally considered to be standards in the industry.

Figure 11:
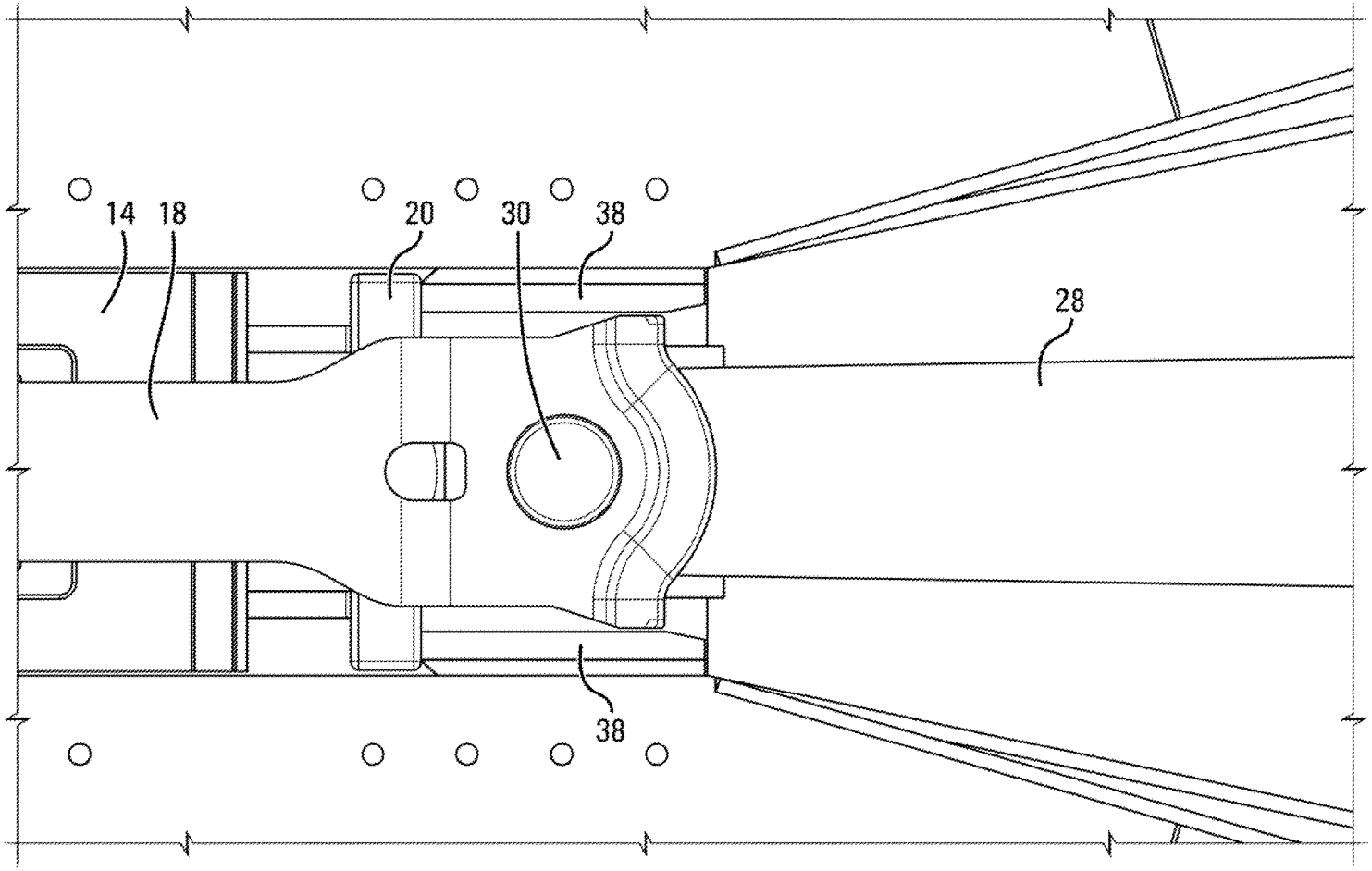
FIG. 11 is a detailed view of a connection between a pulling bar and an elongated member of the end-of-car energy management system.
Figure 12:
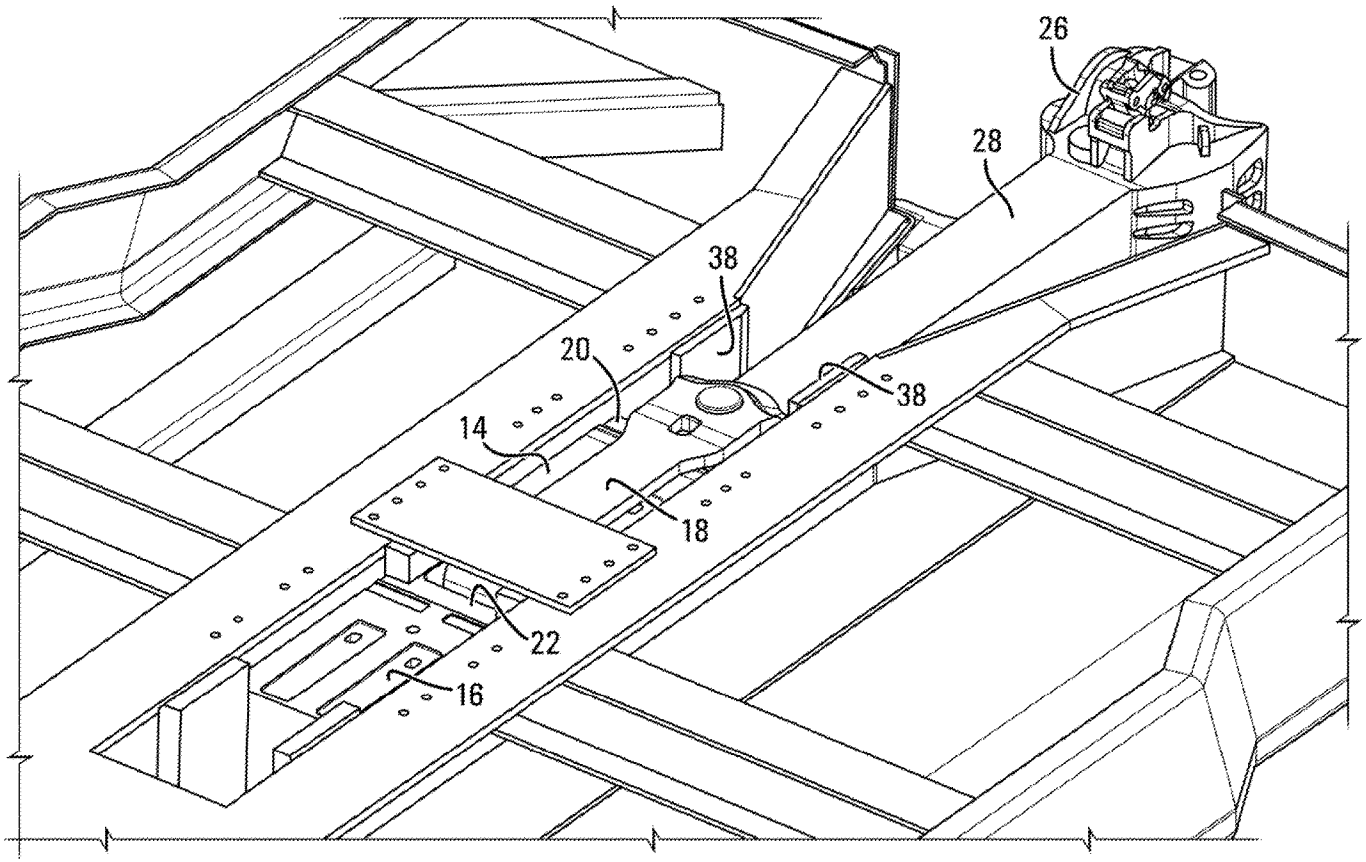
FIG. 12 is rear perspective view of the end-of-car energy management system in the buff operational position with certain components removed for better visibility.

The first draft gear unit 14 is slidably mounted in the pocket 104, its sliding movement in a buff direction being limited by the follower block 22 and its sliding movement in a draft direction being limited by a set of front lugs 38 (shown in FIGS. 11 and 12).

A proximal end 42 of the first draft gear unit 14 engages the follower block 22 when the first draft gear unit 14 is compressed in a buff direction. At the opposite end, a distal end 50 of the first draft gear 14 engages the front follower 20 when the first draft gear unit 14 is compressed but in a draft direction.

Figure 8:
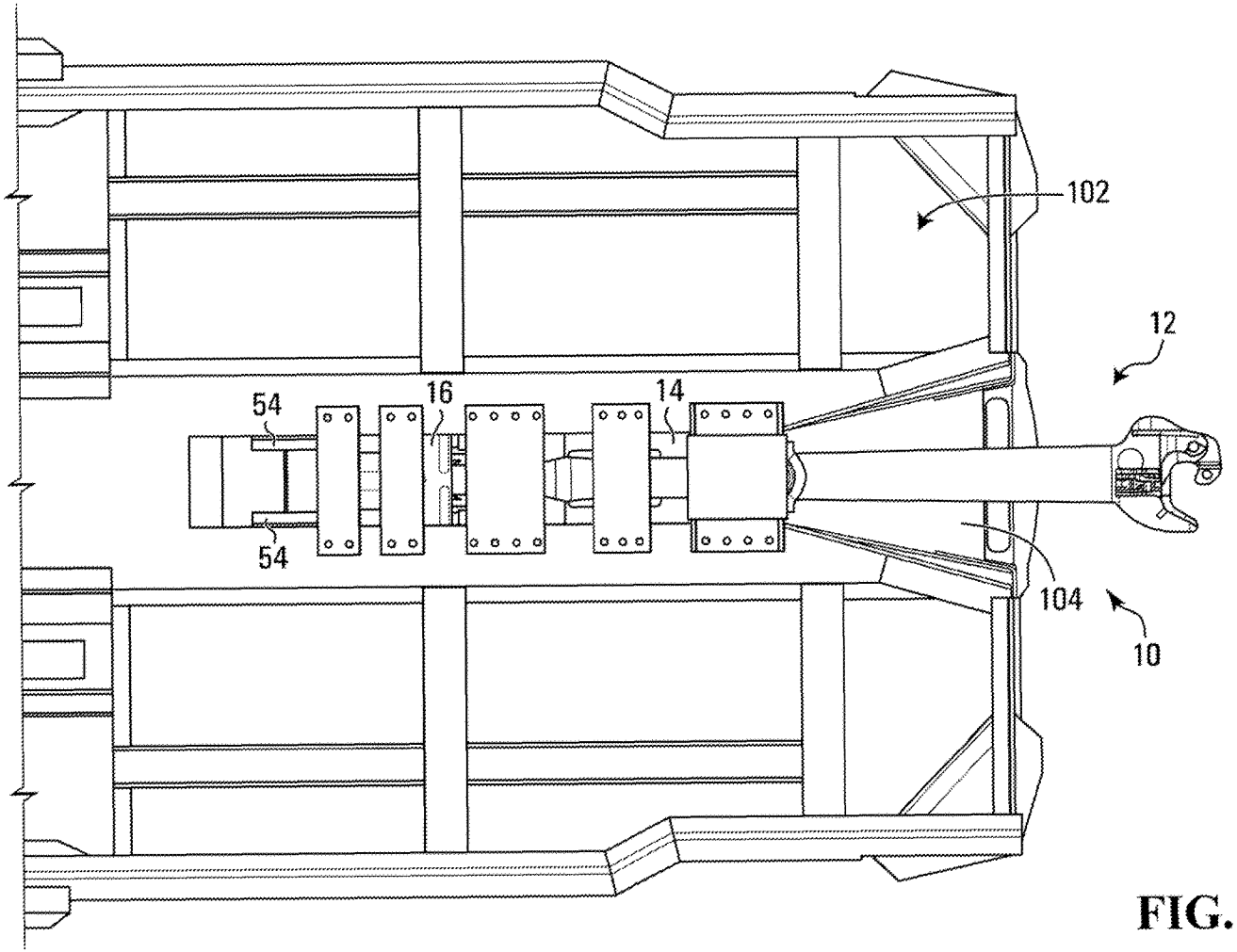
FIG. 8 is a top view of the end-of-car energy management system as installed in a centrally located pocket on the railcar frame.
Figure 9:
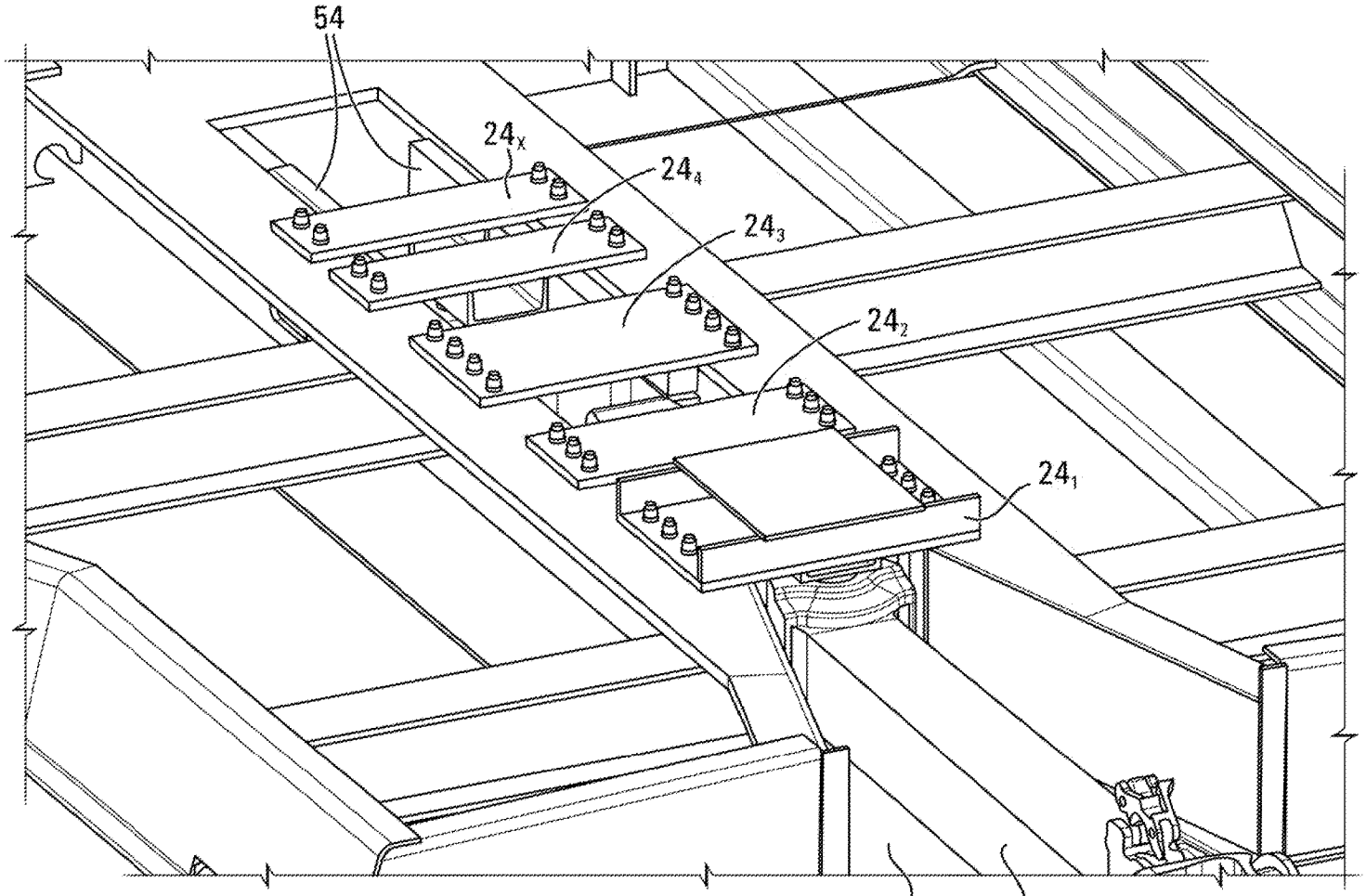
FIG. 9 is a front perspective view of the end-of-car energy management system as installed in the centrally located pockets on the railcar frame.
Figure 10:
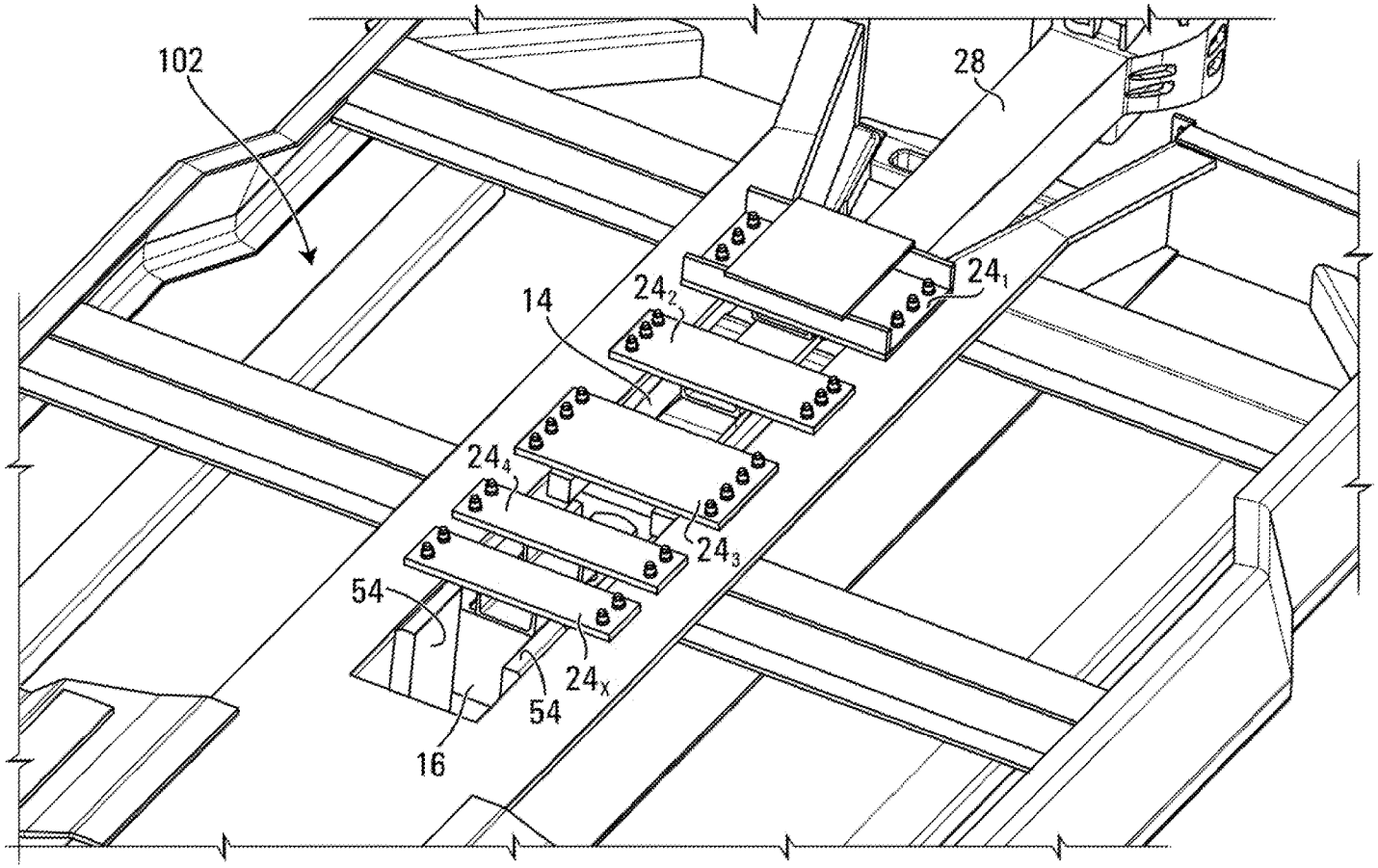
FIG. 10 is a rear perspective view of the end-of-car energy management system is installed in the centrally located pocket on the real car frame.

The second draft gear unit 16, which is identical to the first draft gear unit 14, also comprises a housing 46 and a friction clutch 48 and operates similarly to the first draft gear unit 14. A stroke length $S_2$ of the second draft gear unit 16 may be smaller, equal to, or bigger than the stroke length $S_1$ of the first draft gear unit 14. However, contrary to the first draft gear unit 14, the second draft gear unit 16 has a fixed position and therefore does not slide in the pocket 104. The second draft gear unit 16 has a distal end 44 and a proximal end 52. The proximal end 52 abuts against rear lugs 54 which are more clearly shown in FIGS. 8 to 10. In this embodiment, the front lugs 38 and the rear lugs 54 are welded into the passage defined by the pocket 104.

Figure 4:
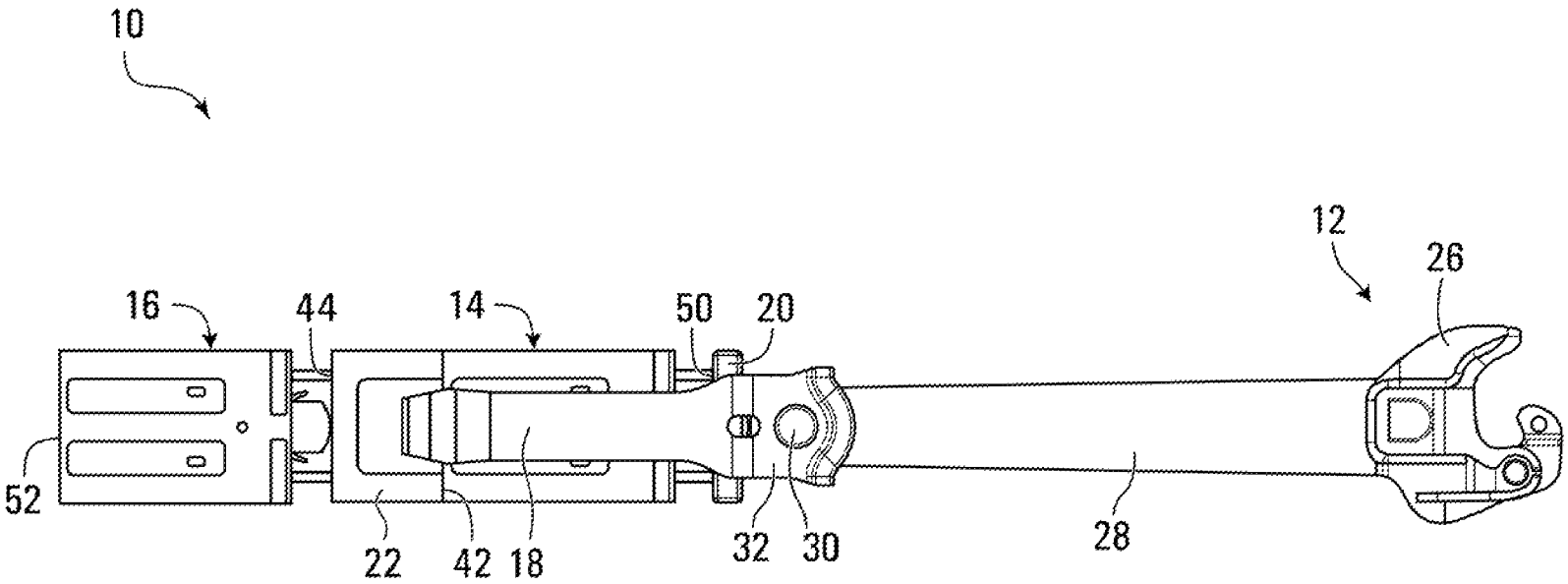
FIG. 4 is a more detailed top view of the end of car energy management system.
Figure 5:
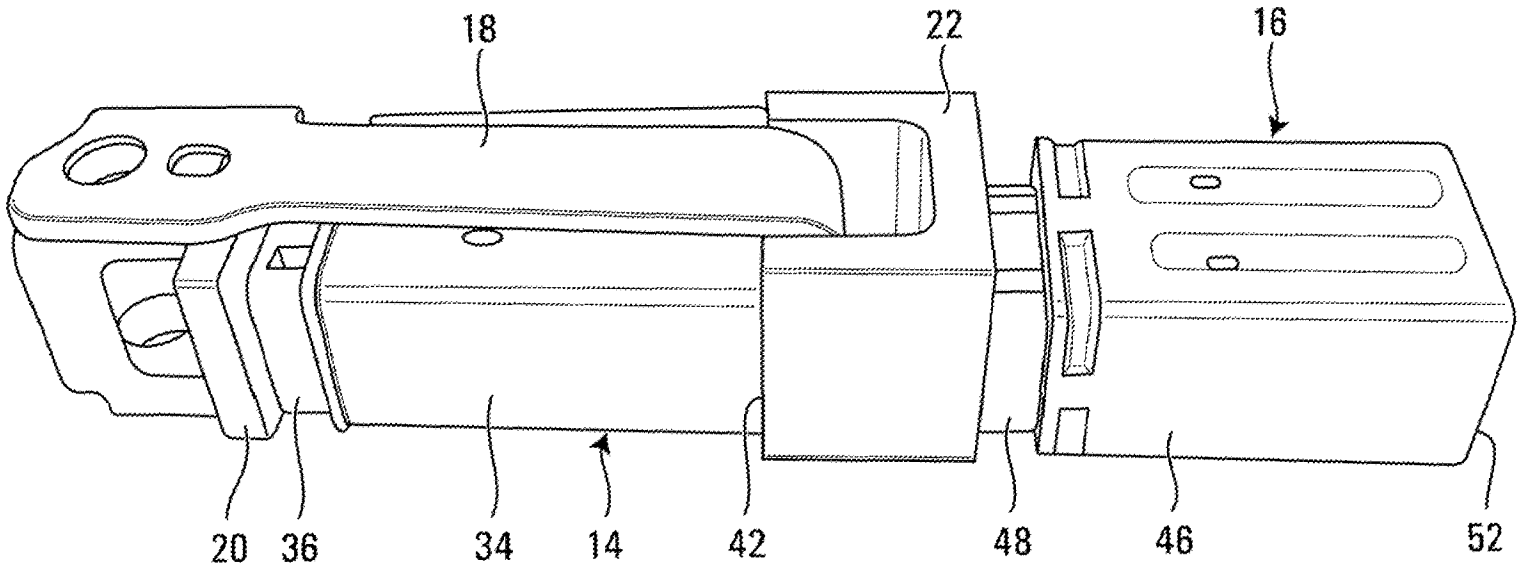
FIG. 5 is a perspective view of the end-of-car energy management system of FIG. 4.

As shown in FIGS. 4 and 5, the first and second draft gear units 14, 16 are arranged serially.

The front follower 20 is operable to compress the first draft gear unit 14 when the asymmetric draft gear mechanism 10 is subjected to buff or draft forces. The front follower 20 is a generally rectangular plate dimensioned such as to fit within the pocket 104 and to be able to slide therein. The front follower 20 is made of metallic material suitable for withstanding high loads. Other shapes and other suitable materials may be used for the front follower 20 in other embodiments.

As best shown in FIGS. 4 and 5, the follower block 22 is generally C-shaped, abutting against the distal end 44 of the second draft gear unit 16 and as such is operable for transmitting a compression force to the second draft gear unit 16. The follower block 22 is made of metallic material suitable for withstanding high loads. However, in other embodiments, any other suitable material capable of withstanding high loads may be used.

The pulling bar 18 extends longitudinally along the top surface of the first draft gear unit 14. The purpose of the pulling bar 18 is to actuate the first draft gear unit 14 when the railcar is subjected to draft forces (pulling forces). The pulling bar 18 has an extremity that bends downwardly into a space between the follower block 22 and the extremity 42 of the first draft gear unit 14. At its opposite end, the pulling bar 18 is connected to the elongated member 28 such that when the elongated member 28 is subjected to draft forces the extremity of the pulling bar 18 that bends downwardly engages the proximal end 42 of the first draft gear unit 14 and causes the first draft gear unit 14 to compress against the follower 20.

Through the above-described assembly of components, the end-of-car system 10 provides an asymmetric draft gear-based shock absorption mechanism that provides a shock absorption function both in the buff and draft directions. The mechanism combines the compression stroke of two standard draft gear units to achieve an overall compression stroke in the buff direction, which provides the desired degree of shock absorption capability and which is comparable to the one provided by traditional hydraulic units. At the same time, the mechanism provides shock absorption in the draft direction, which is of a more limited magnitude since that function uses only one of the draft gear units.

Figure 6B:
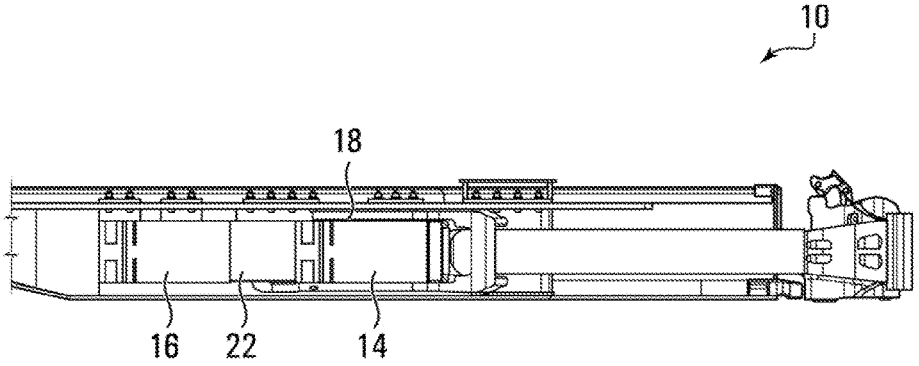
FIG. 6B is a longitudinal cross-sectional view of the end-of-car energy management system in a buff operational position.
Figure 7B:
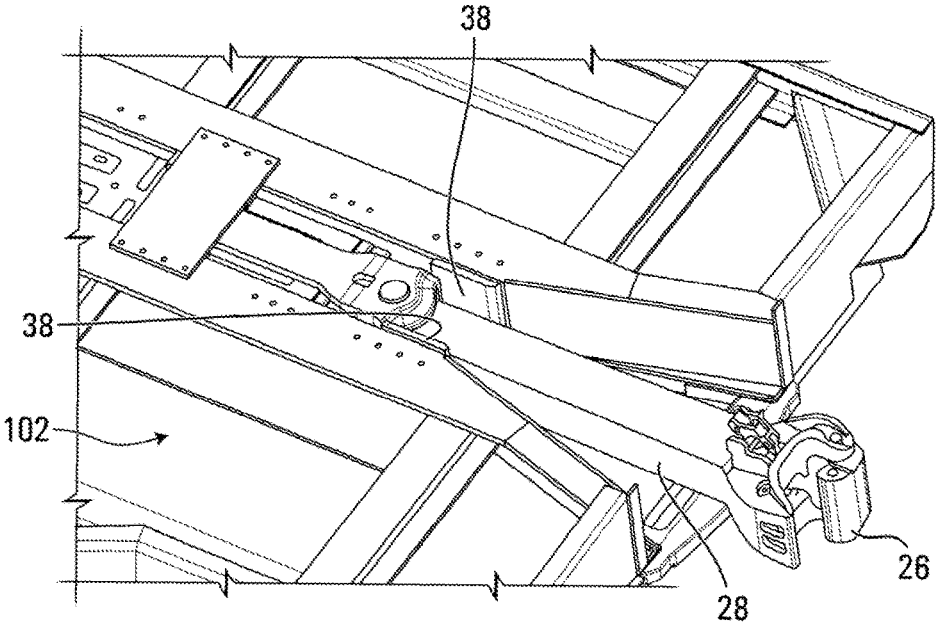
FIG. 7B is a perspective view of a frontmost part of the end-of-car energy management system in the buff operational position.

To elaborate, when the asymmetric draft gear 10 is subjected to a buff or compression force, such as when another railcar is pushed against the railcar 100 when coupling for example, the coupler assembly 12 moves inwardly into the pocket 104 of the railcar 100 causing the elongated member 28 to push the front follower 20 inwards. This compresses the first draft gear unit 14 which retracts from its neutral position. The proximal end 42 of the first draft gear unit 14 transmits the compressive force to the follower block 22 which in turn compresses the second draft gear unit 16 which also retracts from its neutral position. The first draft gear unit 14 slides in the pocket 104, as the second draft gear unit 16 compresses. This sequence of actions thus combines the strokes of both draft gears units 14, 16 in order to absorb the compression force being applied. FIGS. 6B and 7B show the end-of-car system 10 in a final buff operational position after going through the above-described steps. Once the compression force is no longer being applied, the draft gear units 14, 16 return to their neutral operational position since they are internally spring biased.

Figure 6C:
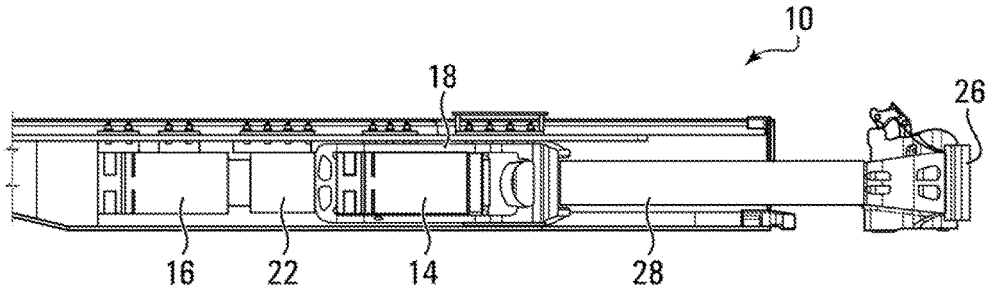
FIG. 6C is a longitudinal cross-sectional view of the end-of-car energy management system in a draft operational position.
Figure 7C:
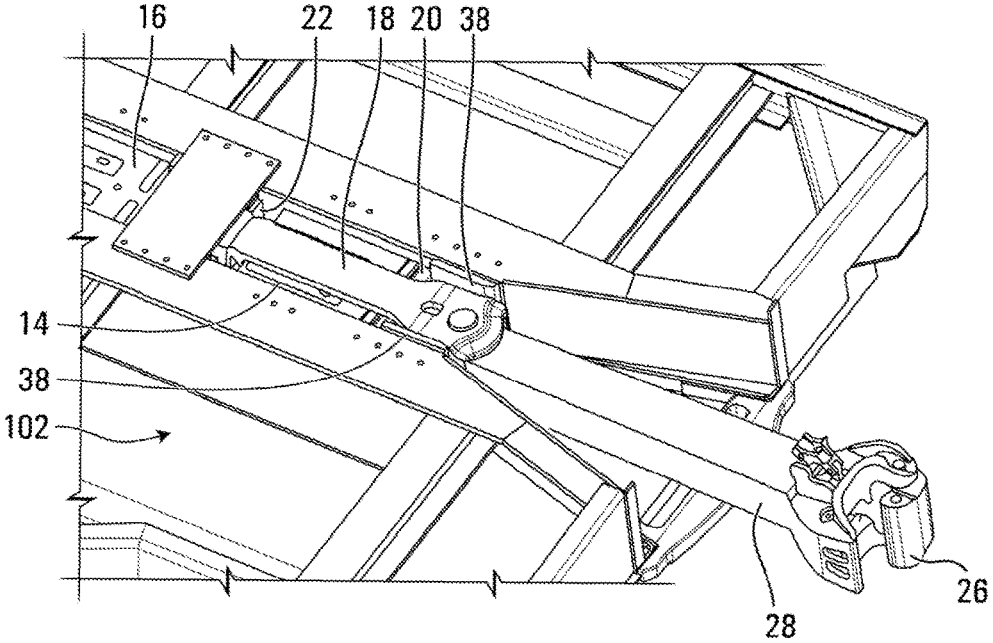
FIG. 7C is a perspective view of a frontmost part of the end-of-car energy management system in the draft operational position.

When the end-of-car system 10 is subjected to a draft or tension force, such as when the end-of-car system 10 is pulled for example, the coupler assembly 12 is pulled outwards from the pocket 104 and away from the railcar 100. The elongated member 28 pulls on the pulling bar 18 which, in turn, engages the proximal end 42 of the first draft gear unit 14. The first draft gear unit 14 can then slide in the pocket 104 forwardly, compressing against the front follower 20. Once the front follower 20 engages the front lugs 38, the first draft gear unit 14 is once again compressed and causes the friction clutch 34 to retract into the housing 36. This compression of the first draft gear unit 14 effectively absorbs the impact that the end-of-car system 10 is subjected to. FIGS. 6C and 7C show the end-of-car system 10 in a final draft operational position after going through the above-described steps.

As described above, a compression force applied on the end-of-car system 10 causes both draft gear units 14, 16 to react. The first draft gear unit 14 is compressed by the front follower 20 being pushed inwards and the second draft gear unit 16 is compressed by the follower block 22 which is driven by the first draft gear unit 14. In contrast, when a tension force is applied to the end-of-car system 10, only the first draft gear 14 unit operates to absorb the impact while the second draft gear unit 16 is left in its fixed position.

Advantageously, the end-of-car system 10 may be retrofitted to railcars having a different type of shock absorption system installed. For instance, a railcar having a buffer unit may be retrofitted with the end-of-car system 10 by removing the buffer unit and installing the end-of-car system 10 within the pocket 104 provided in the railcar. From that perspective, it is useful to design the end-of-car system 10 such that its dimensions fit the internal dimensions of the pocket 104 that is designed to accommodate a different type of shock absorption system such as one using a hydraulic unit.

Any feature of any embodiment discussed herein may be combined with any feature of any other embodiment discussed herein in some examples of implementation. Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. An end of railcar energy management system, comprising:

(a) a first draft gear unit;

(b) a second draft gear unit substantially identical to the first draft gear unit, each of the first and second draft gear units including:

a. a casing;

b. a friction clutch retractable within the housing to produce compression of the draft gear unit;

(c) the first and the second draft gear units being mounted serially, such that a buff force applied at the end of railcar energy management system produces compression of the first draft gear unit and of the second draft gear unit;

(d) a follower block mounted between the first and the second draft gear units, the follower block operable to transmit the buff force applied to the end of railcar energy management system between the first and the second draft gear units;

(e) a pulling bar extending between the follower block and the first draft gear unit, the pulling bar configured to induce compression of the first draft gear unit when a draft force is applied to the end of railcar energy management system.

2. An end of railcar energy management system as defined in claim 1, wherein the first draft gear unit and the second draft gear unit are characterized by a substantially identical stroke length.

3. An end of railcar energy management system as defined in claim 2, wherein a buff stroke of the end of railcar energy management system is approximately double of a draft stroke of the end of railcar energy management system.

4. An end of railcar energy management system as defined in claim 3, including a coupler assembly for enabling a coupling connection between railcars, the pulling bar being connected to the coupler assembly such that a draft force applied to the coupler assembly is transmitted to the first draft gear to induce compression of the first draft gear.

5. An end of railcar energy management system as defined in claim 4, wherein the pulling bar extends along the housing of the first draft gear unit.

6. An end of railcar energy management system as defined in claim 5, wherein the pulling bar includes an end portion and a body portion, the body portion extending along the housing of the first draft gear unit, the pulling bar further including a curved portion between the end portion and the body portion, the curved portion locating the end portion at an angle with relation to the body portion, the end portion residing between the follower block and the first draft gear unit.

7. An end of railcar energy management system as defined in claim 1, wherein the end of railcar energy management system is characterized by a buff stroke and by a draft stroke, the buff stroke being larger than the draft stroke.

8. An end of railcar energy management system as defined in claim 7, wherein the follower block includes a recessed portion receiving the pulling bar.

9. An end of railcar energy management system as defined in claim 8, wherein the follower block is C-shaped.

10. An end of railcar energy management system as defined in claim 8, including a coupler assembly for enabling a coupling connection between railcars, the pulling bar being connected to the coupler assembly such that a draft force applied to the coupler assembly is transmitted to the first draft gear to induce compression of the first draft gear.

* * * * *